US009103342B2

(12) United States Patent
Jaeschke et al.

(10) Patent No.: US 9,103,342 B2
(45) Date of Patent: Aug. 11, 2015

(54) UNDERWATER DELIVERY UNIT

(75) Inventors: Axel Jaeschke, Minden (DE); Joerg Lewerenz, Liekwegen (DE)

(73) Assignee: Joh. Heinr. Bornemann GmbH, Oberkirchen (DE)

( * ) Notice: Subject to any disclaimer, the term of this patent is extended or adjusted under 35 U.S.C. 154(b) by 485 days.

(21) Appl. No.: 12/936,966

(22) PCT Filed: Apr. 6, 2009

(86) PCT No.: PCT/DE2009/000470

§ 371 (c)(1),
(2), (4) Date: Nov. 30, 2010

(87) PCT Pub. No.: WO2009/124536

PCT Pub. Date: Oct. 15, 2009

(65) Prior Publication Data

US 2011/0064592 A1 Mar. 17, 2011

(30) Foreign Application Priority Data

Apr. 10, 2008 (DE) ..... 10 2008 018 407

(51) Int. Cl.

| | |
|---|---|
| ***F04D 13/08*** | (2006.01) |
| ***F04D 29/10*** | (2006.01) |
| ***F04C 13/00*** | (2006.01) |
| ***F04D 25/06*** | (2006.01) |
| ***F04C 11/00*** | (2006.01) |

(52) U.S. Cl.

CPC ..... *F04C 13/008* (2013.01); *F04C 11/008* (2013.01); *F04D 13/08* (2013.01); *F04D 13/086* (2013.01); *F04D 25/0686* (2013.01); *F04D 29/104* (2013.01); *F04D 29/108* (2013.01); *F04C 13/007* (2013.01); *F04C 2210/24* (2013.01); *F04C 2240/30* (2013.01)

(58) Field of Classification Search

CPC . F04D 13/086; F04D 13/0653; F04D 13/062; F04D 25/0686; F04D 29/104; F04D 29/108; F04D 13/08; F04C 13/008

USPC ..... 417/360, 410.4, 414, 423.12, 423.3, 417/423.8, 902; 137/538

See application file for complete search history.

(56) References Cited

U.S. PATENT DOCUMENTS

| | | | | |
|---|---|---|---|---|
| 2,423,436 | A * | 7/1947 | Blom | 417/414 |
| 2,871,791 | A * | 2/1959 | Litzenberg | 417/357 |
| 3,041,977 | A * | 7/1962 | Boyd | 417/414 |
| 3,118,384 | A * | 1/1964 | Sence et al. | 417/370 |
| 3,267,868 | A * | 8/1966 | Page | 417/370 |
| 3,558,018 | A * | 1/1971 | Hudig | 222/385 |

(Continued)

FOREIGN PATENT DOCUMENTS

| | | |
|---|---|---|
| DE | 3721398 | 6/1987 |
| DE | 100 81 956 | 6/1999 |

(Continued)

*Primary Examiner* — Alexander Comley

(74) *Attorney, Agent, or Firm* — Whitham Curtis Christofferson & Cook, PC

(57) ABSTRACT

The invention relates to an underwater delivery unit with a pump and a drive device that is sealed against the surrounding water and a process medium. According to the invention, the pump (31) and the drive device (32) are combined into a module with a module housing (3) and are arranged in a pressure housing (2), wherein the pressure housing (2) is filled with the process medium and surrounds the module housing (3).

17 Claims, 1 Drawing Sheet

(56) References Cited

U.S. PATENT DOCUMENTS

| | | | | | |
|---|---|---|---|---|---|
| 3,694,110 | A | * | 9/1972 | Guinard | 417/423.3 |
| 3,715,863 | A | * | 2/1973 | Zanoni | 96/170 |
| 3,764,233 | A | * | 10/1973 | Strickland | 417/414 |
| 3,764,236 | A | * | 10/1973 | Carter | 417/372 |
| 3,975,117 | A | * | 8/1976 | Carter | 417/370 |
| 4,652,218 | A | * | 3/1987 | Tsutsui et al. | 417/368 |
| 4,889,468 | A | * | 12/1989 | Ishikura | 415/146 |
| 4,932,848 | A | * | 6/1990 | Christensen | 417/414 |
| 5,096,391 | A | * | 3/1992 | Tuckey | 417/423.3 |
| 5,193,985 | A | | 3/1993 | Escue et al. | |
| 5,336,064 | A | * | 8/1994 | Lamers | 417/423.3 |
| 5,478,215 | A | * | 12/1995 | Kobayashi et al. | 417/423.14 |
| 5,494,418 | A | * | 2/1996 | Moriya et al. | 417/423.14 |
| 5,591,016 | A | * | 1/1997 | Kubota et al. | 417/365 |
| 5,648,694 | A | * | 7/1997 | Kobayashi et al. | 310/87 |
| 5,857,841 | A | * | 1/1999 | Kobayashi et al. | 417/350 |
| 6,012,909 | A | * | 1/2000 | Sloteman et al. | 417/366 |
| 6,059,539 | A | * | 5/2000 | Nyilas et al. | 417/228 |
| 6,200,108 | B1 | * | 3/2001 | Caudill et al. | 417/366 |
| 6,350,109 | B1 | * | 2/2002 | Brunet et al. | 417/365 |
| 6,447,269 | B1 | * | 9/2002 | Rexroth et al. | 417/365 |
| 6,695,594 | B1 | * | 2/2004 | Pastori | 417/417 |
| 2005/0069434 | A1 | * | 3/2005 | Tani | 417/423.12 |

FOREIGN PATENT DOCUMENTS

| | | |
|---|---|---|
| EP | 0 634 827 | 7/1994 |
| EP | 0 719 940 | 12/1995 |
| RU | 2208710 C2 | 7/2003 |
| RU | 81471 | 3/2009 |
| WO | WO 92/06299 | 4/1992 |
| WO | WO 98/00643 | 1/1998 |

* cited by examiner

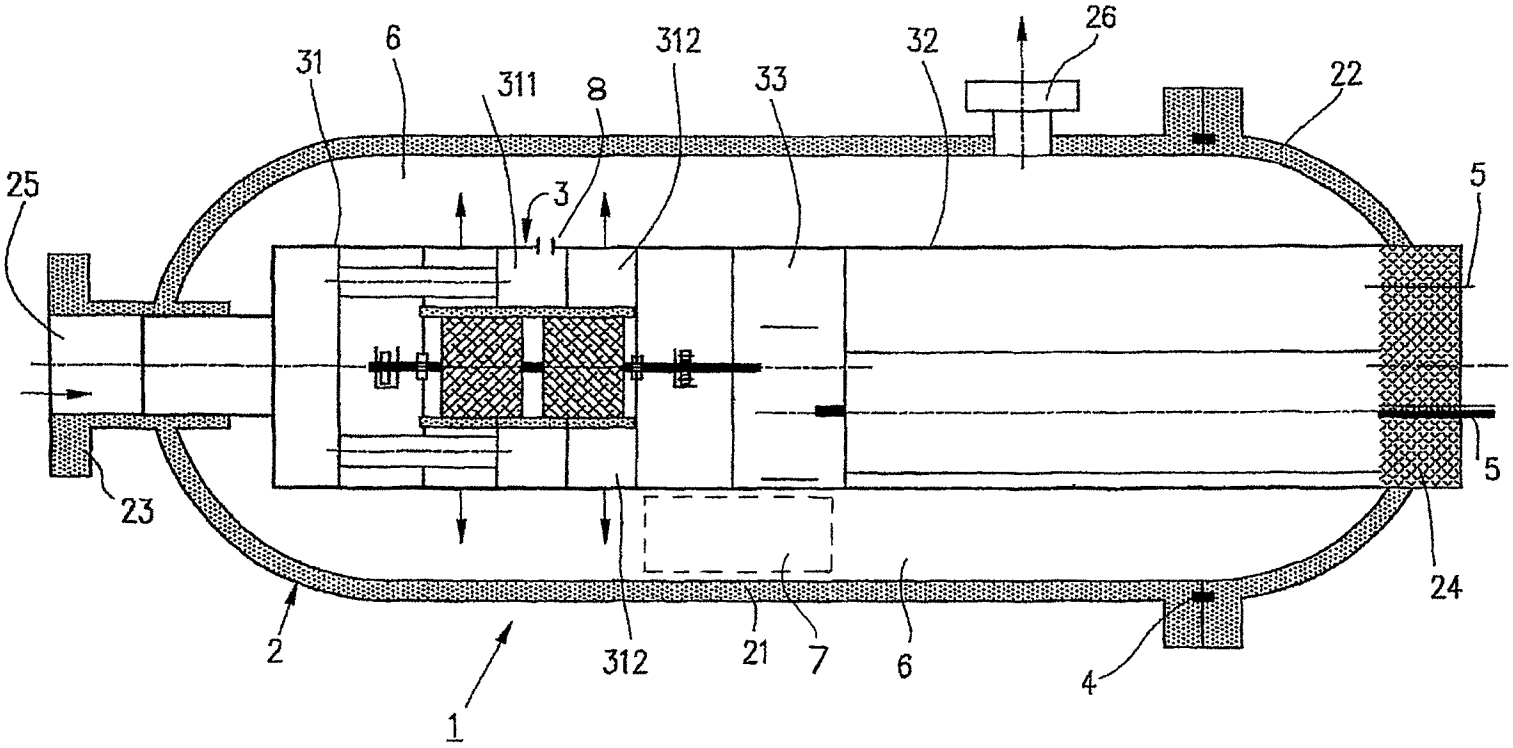
5
5
24
22
26
4
32
6
33
7
21
312
312
8
3
311
1
6
31
2
23
25

UNDERWATER DELIVERY UNIT

FIELD OF THE INVENTION

The invention relates to an underwater delivery unit having a pump and a drive device, in which the drive device is sealed from the surrounding water and from a process medium. The invention is particularly suitable, and is intended, for delivery of multiphase mixtures.

BACKGROUND

DE 37 21 398 A1 describes a delivery unit comprising a pump with a drive device, with the pump being surrounded on all sides by a pump housing which has a suction area with an induction opening, and a pressure area with an outlet opening. The pump housing is designed to be water-tight and is connected to a motor housing, which is likewise designed to be water-tight, holds the drive device and encloses a motor area which surrounds the encapsulated drive unit and is separated from the suction area in a liquid-tight manner. The motor area is filled with a barrier medium, in the present case with oil, which is used to lubricate the bearing, any gearwheels or the like, acts on the seals, and emits the heat via the motor housing to its surrounding area. Underwater delivery devices such as these are used to deliver hydrocarbons in the sea.

Resources are being discovered at ever greater water depths in the sea for crude oil and natural gas production, and water depths up to 4000 m are no rarity in this case. The requirements for pipeline systems and delivery units, relating to the capability to resist hydrostatic pressures from the outside resulting from the water pressure head and internally from the reservoir pressure caused by the crude oil and natural gas, are also correspondingly becoming more stringent. Normally, pipeline systems for deep-ocean delivery are designed for an overpressure from the inside of 300 to 500 bar, and must withstand an overpressure from the outside of up to 400 bar, depending on the water depth.

As additional requirements, the temperatures of the surrounding water and those of the delivery medium or process medium are different, and while the water temperature is between 1 and 4° C., the process medium will become hot up to more than 100° C., thus resulting in correspondingly high thermal loads. All components which are integrated in a delivery system must at least be able to withstand the loads mentioned above.

Pump systems for delivery of hydrocarbons in the deep ocean are generally designed such that the pump and the drive device, such as the motor and clutch, are installed in a common housing. This avoids the technically critical need to pass a shaft from the pump housing to the motor housing. In this case, there is an area which is filled by the process medium, specifically the suction area, the delivery chambers of the pump and the pressure area, and an area which is not filled by the process medium, with the motor, bearing and clutch. The two areas are separated from one another by shaft sealing; the area which is not filled with the process medium and has the motor, bearing and clutch area is filled with a barrier medium, normally with water or oil.

This concept has the disadvantage that there is a close link between the pressure-beating housing and the narrow tolerances which are required for operation, for rotating elements and sealing components. It must be possible to absorb deformations caused by the pressures which occur of +350 to −500 bar and temperature fluctuations from 1° C. to more than 100° C., at a number of points which react sensitively to shape and position changes, for example bearings, shaft seals and a motor gap. Large viscosity fluctuations also occur in the barrier medium, when this is in the form of oil. When not in a delivery phase, the motor and the pump cool down to the ambient temperature when stationary; during operation, they are heated by the temperature of the process medium and by friction to 60° C. to 80° C. The barrier oil viscosities, which vary because of this, from about 100 cSt in a cold system and to less than 2 cSt in a hot system, require special measures in the barrier oil system. The lubricating and load-bearing capability of the barrier oil must be maintained both in the cold state and in the hot state. Furthermore, in the cold state, large hydraulic friction losses must be overcome, for example in the motor.

The number of sealing points to the surrounding area in an underwater delivery unit must be minimized as far as possible, since sealing points represent a potential fault source and have a tendency to leak, and a small leakage can be identified only with major difficulty, while any leakage should be avoided, for environmental protection reasons.

The joint delivery of crude oil and natural gas means that liquids and gases are transported alongside one another. When delivering crude oil and natural gas, a so-called multiphase mixture is delivered, in which there is a high probability of only one phase being temporarily present, that is to say only liquids or only gaseous components will be delivered over considerable time periods. Furthermore, the composition of the multiphase mixture fluctuates over a wide range and over relatively long time periods, thus resulting in particularly stringent requirements for the pump technology in this case.

SUMMARY

The object of the present invention is therefore to provide an underwater delivery unit for hydrocarbons, which operates reliably and reduces the risk of environmental damage caused by leaks, without adversely affecting the functionality and reliability.

According to the invention, this object is achieved by an underwater delivery unit having the features of claim 1. Advantageous refinements and developments of the invention are specified in the dependent claims.

The underwater delivery unit according to the invention having a pump and a drive device, in which the drive device is sealed from the surrounding water and from a process medium, provides that the pump and the drive device are combined to form a module in a module housing and are arranged in a pressure housing, wherein the pressure housing is filled with the process medium during operation and surrounds the module housing. The arrangement of the pump and drive device within a module housing completely decouples the pump and the drive device, as well as the transmission devices or clutches and control devices which normally have to be provided, from the ambient pressure and the temperature caused by the water pressure head. The active pressure equalization of the module internal pressure at a constant overpressure with respect to the surrounding process medium completely avoids alternating pressure loads on the module housing, in contrast to conventional solutions. Because of the modular design of the delivery unit with the pump and the drive device in a module housing, all the rotating and critical-tolerance components are combined to form one unit, in which case the module housing which is responsible for the shape change experiences constant pressure forces and is decoupled from the external pressure, which loads the pressure housing. The process medium prevents direct contact between the module housing and the surrounding water, thus leading to the operating temperature being made more uniform and to a lower temperature gradient, as a result of which the pump and the drive are subjected to reduced thermal loads. Overall, the module housing can be designed for substantially constant forces, which means a reduction in the design complexity and at the same time higher effectiveness of the pump, with a lower failure probability at the same time.

One development of the invention provides that the module housing is mounted in the pressure housing forming an annular area, as a result of which the module housing can be completely surrounded by the process medium, with the exception of the module housing bearing points which are required within the pressure housing. The annular area is in this case at the same time used as a separation device via which a liquid phase can be separated from a gas phase. The annular area may be used as a hold-back area for a liquid phase, provided that it is arranged on the suction side, in order to supply a separated liquid phase as required to the suction area of the pump, in order to supply the pump, which is generally in the form of a screw-type pump, with a sufficient amount of liquid phase in order on the one hand to ensure gap sealing of the movement gaps between the screw spindles which are arranged parallel to one another, and on the other hand to provide lubrication and cooling. If the annular area is arranged on the pressure side, it can be used as a separation area, allowing recirculation of liquid phase which has already been delivered via a short-circuiting line into the induction area of the pump.

For mechanical decoupling, the module housing is mounted at least at one bearing point in the pressure housing such that it can move, such that a loose bearing in the axial direction ensures the necessary decoupling of the module and/or module housing from thermal or hydrostatic deformations of the pressure housing. The module housing is preferably cylindrical, in order to ensure high pressure stability, with the pressure housing preferably being arranged concentrically around the module housing.

Separation devices can be arranged within the pressure housing and/or within the module housing in order to separate a liquid phase and a gas phase of a multiphase mixture, for example in the form of bypass devices or rest zones, or deliberately increases in the flow cross section, in order to reduce the flow velocities and to separate the liquid phase and the gas phase by the force of gravity. The separate liquid phase can then either be passed within the module housing or back from the pressure housing into the suction area of the pump, in order to recirculate the separated liquid phase, if this is necessary, for example when only gas phase is being delivered over a relatively long time period. The recirculation serves to maintain the gap sealing and the cooling of the delivery elements.

Preferably, the module housing is mounted within the pressure housing at one point in a fixed bearing, wherein the fixed bearing is preferably equipped with bushings through the pressure housing, for example in order to pass electrical or hydraulic supply lines to the module housing and the drive device. The bushings can easily and reliably be statically sealed.

A recirculation line can be provided from the pressure area of the pump to the suction area of the pump, in order to pass a separated liquid phase in a metered manner to the suction area. The separation and the storage capability for the separated liquid phase may in this case be provided independently of the orientation of the pressure housing, or of the pump and the drive device, such that liquid phase and gas phase can be separated both in the case of horizontal installation and in the case of vertical installation.

A hold-back area for the liquid phase can be provided on the suction side in the pressure housing and/or in the module housing, in order to provide an adequate supply for gas-phase delivery time periods.

The inlet side and the outlet side of the underwater delivery unit can be connected to one another by at least one non-return valve, which ensures that the process medium can pass through freely in one direction and blocks it in the other direction, thus ensuring that the process medium can pass through freely even when the pump is not activated, making it possible to ensure free exchange.

It is also possible to provide devices for preprocessing the process medium, for solids deposition and/or for supplying additives, for example chemicals etc., such that the process medium can be optimally delivered and preprocessed.

In order to reduce noise emissions, all the contact points between the pressure housing and the module housing can be provided with oscillation dampers. When the module housing is mounted in the pressure housing with an axially free loose bearing, the loose bearing can also be used as an inlet connecting stub for the process medium, as a result of which the process medium is delivered through the loose bearing point in the pressure housing into the suction area of the pump, and from there into the annular area of the pressure housing. The process medium is transported away from the pressure area via an appropriate pipeline.

The provision of the module comprising the pump and drive device in a common module housing has the advantage that the mechanically active element can be completely prefabricated and tested, and just has to be inserted into a surrounding pressure housing. No mechanically moving parts need be sealed from the environment, and in fact leaks within the pump may also not be damaging, since leakages are held in the completely closed pressure housing. All that happens is that the efficiency may be reduced thereby. The mechanically simple form of the pressure housing with the interfaces being minimized and with interlocking and/or force-fitting bearing points between the module housing and the pressure housing allows a very free choice with respect to the material, the manufacturing process and the pressure level of the pressure housing. The number of seals to surrounding areas is minimized, and the seals are restricted to seals which do not rotate. The installation area for the seals can in this case be chosen largely freely.

All the mechanical functions of the underwater delivery unit are contained in the module housing. Only the module housing is required to test operation. Since the module housing no longer need absorb the pressure forces of the water pressure head and the absolute process pressure, the dimensions and the weight can be reduced, and the accessibility to components can be simplified. This also allows the module to be completely functionally tested with less effort.

The pressure housing is designed independently of design considerations relating to the pump, simply with respect to the maximum external and internal pressure, as well as the process temperature and ambient temperature and the chemical composition of the process medium while, in contrast, the module housing must provide adequate dimensional stability for the mechanical loads and a housing which provides sufficient resistance for the temperature fluctuations and adequately equalizes the pressure for the constant module overpressure, and which housing is largely decoupled from the deformations of the pressure housing and the externally acting loads.

The module housing can be mounted in the pressure housing via oscillation-damping bearing points, for example rubber-metal bearings, in order not to transmit any sound emissions from the module housing to the pressure housing, or to prevent such transmission as far as possible. This reduces sound emission from the pressure housing to the surrounding area, since, when multiphase mixtures are being delivered, the annular area which is located around the module housing is already in the form of an area which transmits little sound, by virtue of the gas content in the delivery medium. All contact points between the module housing and the pressure housing can be designed with oscillation isolation, or can be equipped with oscillation dampers.

BRIEF DESCRIPTION OF THE DRAWINGS

One exemplary embodiment of the invention will be explained in more detail in the following text with reference to the single FIG. 1.

The FIGURE shows a schematic section illustration of a delivery unit.

DETAILED DESCRIPTION

The FIGURE shows an underwater delivery unit 1 having an external pressure housing 2, which consists of two housing parts 21, 22, as well as a module housing 3 arranged in it, with the module housing 3 holding a pump 31 and a drive device 32 with a clutch 33. The drive device 32 and the clutch 33 are sealed by means of a barrier medium against any ingress of a process medium. At its right-hand end, the module housing 3 is mounted in a fixed bearing 24 on the second pressure housing part 22, and is provided with bushings for electrical and hydraulic supply lines 5. On the left-hand side, the pressure housing 31 is mounted in an inlet connecting stub 25 such that it can move axially, such that the left-hand end of the module housing 3 is in the form of a loose bearing. Two flanges 23, 26 are arranged on the pressure housing 2, via which a connection can be made with a pipeline system.

The module housing 3 is arranged in the pressure housing 2 such that an annular area 6 is created around the module housing 3, and is filled with process medium. The process medium is delivered through the inlet connecting stub 25 into the suction area 311 of the pump 31, and is pumped from there through the pressure area 312 into the annular area 6, as indicated by the arrows. The process medium is then transported away from the annular area 6 through the outlet connecting stub 26.

The delivery pressure acts from the inside on the wall of the pressure housing 2, and the water pressure head acts on it from the outside, while the delivery pressure acts on the module housing 3 from the outside and the pressure of the barrier medium acts on it from the inside, with the pressure of the barrier medium being deliberately set for the operating conditions. A small constant overpressure, normally of between 1 and 25 bar, is normally desirable from the barrier medium to the process medium in the pressure housing 2. This results in constant pressure compensation in the entire module with respect to the surrounding process pressure, and complete decoupling from the ambient pressure, that is to say the pressure of the water pressure head. The mechanical design of the module housing 3 can in this case be based on small, but in particular constant, forces.

Separation devices 7, such as bypass elements, labyrinths or deliberate increases in cross section, can be provided within the annular area 6, in order to provide improved separation efficiency. A short-circuiting line 8 can be passed from the annular area 6 to the suction area 311 of the pump 31, in order to allow recirculation of a separated liquid phase.

The arrangement of a substantially concentric annular area 6 around the module housing 3 makes it possible, by the configuration of an appropriately designed pressure housing 2, to provide thermal insulation between the module housing 3 and the environment, that is to say the sea, such that only slow cooling down takes place when the pump 31 is stationary. Non-return valves can likewise be arranged, allowing the process medium to be continuously exchanged from the inlet connecting stub 25 to the outlet 26 when the pump 31 is stationary, thus making it possible to keep the temperature of the module housing 3, and therefore the temperature of the pump 31 and of the drive device 32, substantially constant, since a continuous exchange of the process medium takes place.

The invention claimed is:

1. An underwater delivery unit, comprising:

a pump having a suction area and a pressure area, wherein said suction area precedes all movement gaps of said pump;

a drive device, wherein said drive device is sealed from surrounding water and from a process medium, wherein said pump and said drive device are combined to form a module with a module housing and are arranged in a pressure housing, wherein said pressure housing is filled with said process medium and surrounds said module housing, said process medium preventing direct contact between said module housing and the surrounding water;

wherein said drive device is sealed against ingress of said process medium by a barrier medium that is different from said process medium;

wherein an outside of a wall of said pressure housing is acted on by a water pressure head, both an inside of said wall of said pressure housing and an outside of a wall of said module housing are acted on by a delivery pressure of said process medium, and an inside of said wall of said module housing is acted on by a barrier medium pressure, wherein said delivery pressure and said barrier medium pressure are determined by said pump to subject said module housing to substantially constant forces;

a recirculation line extending from said pressure area or said pressure housing to said suction area and through which separated liquid phase is passed to said suction area; and separation devices arranged within one or more of said pressure housing and said module housing, said separation devices being configured to separate a liquid phase and a gas phase of a multiphase mixture.

2. The underwater delivery unit as claimed in claim 1, wherein the module housing is mounted in the pressure housing forming an annular area.

3. The underwater delivery unit as claimed in claim 1, wherein the module housing is mounted at at least one bearing point such that the module housing can move in the pressure housing.

4. The underwater delivery unit as claimed in claim 1, wherein the module housing is mounted within the pressure housing in a fixed bearing which is equipped with bushings through the pressure housing.

5. The underwater delivery unit as claimed in claim 1, further comprising a hold-back area for a liquid phase provided on a suction side in the pressure housing and/or the module housing.

6. The underwater delivery unit as claimed in claim 1, further comprising at least one non-return valve, wherein an inlet side and an outlet side of the underwater delivery unit are connected by said at least one non-return valve, said at least one non-return valve ensures that process medium can pass through freely even when the pump is not activated.

7. The underwater delivery unit as claimed in claim 1 further comprising devices for preprocessing the process medium, for solids deposition and/or for supplying additives.

8. The underwater delivery unit as claimed in claim 1 wherein the module housing is mounted with oscillation damping in the pressure housing.

9. An underwater delivery unit, comprising:

a pump having a suction area and a pressure area;

a drive device, wherein said drive device is sealed from surrounding water and from a process medium and wherein said drive device is sealed against ingress of said process medium by a barrier medium that is different from said process medium, wherein said pump and said drive device are combined to form a module with a module housing and are arranged in a pressure housing, wherein said pressure housing is filled with said process medium and surrounds said module housing, said process medium preventing direct contact between said module housing and the surrounding water;

a recirculation line extending from said pressure area or said pressure housing to said suction area and through which separated liquid phase is passed to said suction area; and separation devices arranged within one or more of said pressure housing and said module housing, said separation devices being configured to separate a liquid phase and a gas phase of a multiphase mixture, wherein during operation of said pump, process medium is conducted through said suction area first, through said pressure area second, and into a space between said pressure housing and said module housing third.

10. The underwater delivery unit as claimed in claim 9, wherein the module housing is mounted in the pressure housing forming an annular area.

11. The underwater delivery unit as claimed in claim 9, wherein the module housing is mounted at at least one bearing point such that the module housing can move in the pressure housing.

12. The underwater delivery unit as claimed in claim 9, wherein the module housing is mounted within the pressure housing in a fixed bearing which is equipped with bushings through the pressure housing.

13. The underwater delivery unit as claimed in claim 9, further comprising a hold-back area for a liquid phase provided on a suction side in the pressure housing and/or the module housing.

14. The underwater delivery unit as claimed in claim 9, further comprising at least one non-return valve, wherein an inlet side and an outlet side of the underwater delivery unit are connected by said at least one non-return valve, said at least one non-return valve ensures that process medium can pass through freely even when the pump is not activated.

15. The underwater delivery unit as claimed in claim 9 further comprising devices for preprocessing the process medium, for solids deposition and/or for supplying additives.

16. The underwater delivery unit as claimed in claim 9 wherein the module housing is mounted with oscillation damping in the pressure housing.

17. The underwater delivery unit as claimed in claim 9, wherein an outside of a wall of said pressure housing is acted on by a water pressure head, both an inside of said wall of said pressure housing and an outside of a wall of said module housing are acted on by a delivery pressure of said process medium, and an inside of said wall of said module housing is acted on by a barrier medium pressure, wherein said delivery pressure and said barrier medium pressure are determined by said pump to subject said module housing to substantially constant forces.

* * * * *